US007857629B2

(12) United States Patent
Chin

(10) Patent No.: US 7,857,629 B2
(45) Date of Patent: Dec. 28, 2010

(54) DUAL IN-LINE CONNECTOR

(75) Inventor: Chung-Ta Chin, Taipei (TW)

(73) Assignee: ASUSTek COMPUTER Inc., Taipei (TW)

( * ) Notice: Subject to any disclaimer, the term of this patent is extended or adjusted under 35 U.S.C. 154(b) by 0 days.

(21) Appl. No.: 12/202,349

(22) Filed: Sep. 1, 2008

(65) Prior Publication Data

US 2009/0061662 A1 Mar. 5, 2009

(30) Foreign Application Priority Data

Sep. 3, 2007 (TW) ..... 96132736 A

(51) Int. Cl.
*H01R 12/00* (2006.01)

(52) U.S. Cl. ..... 439/62; 429/74

(58) Field of Classification Search ..... 439/62, 439/67, 74, 736, 701, 83
See application file for complete search history.

(56) References Cited

U.S. PATENT DOCUMENTS 3,922,054 A 11/1975 Dechelette
4,869,672 A * 9/1989 Andrews Jr. ..... 439/60
5,052,936 A * 10/1991 Biechler et al. ..... 439/60
5,277,591 A * 1/1994 Felcman et al. ..... 439/60
5,964,594 A * 10/1999 Saitoh et al. ..... 439/74
6,132,261 A * 10/2000 Lee et al. ..... 439/736
6,447,317 B1 * 9/2002 Billman ..... 439/260
7,192,320 B2 * 3/2007 Yasumura et al. ..... 439/862
7,219,181 B2 5/2007 Carty
7,241,177 B1 7/2007 Lai
2006/0252285 A1 11/2006 Shen

FOREIGN PATENT DOCUMENTS

EP 0802584 10/1997
EP 1478054 11/2004

OTHER PUBLICATIONS

"1st Office Action of China counterpart application", issued on Sep. 25, 2009, p. 1-p. 7.

* cited by examiner

*Primary Examiner*—T C Patel
*Assistant Examiner*—Phuong Nguyen
(74) *Attorney, Agent, or Firm*—Jianq Chyun IP Office

(57) ABSTRACT

A connector having a number of SMT pads and a number of in-line package pins is provided. The connector can be applied to both a peripheral component interconnection (PCI) card and a peripheral component interconnection express (PCIE) card. The number of the connectors can be reduced when the connectors are applied to the circuit board, and more space on the circuit board are then available for other electrical elements to be disposed.

15 Claims, 5 Drawing Sheets

DUAL IN-LINE CONNECTOR

CROSS-REFERENCE TO RELATED APPLICATION

This application claims the priority benefit of Taiwan application Serial No. 96132736, filed on Sep. 3, 2007. The entirety of the above-mentioned patent application is hereby incorporated by reference herein and made a part of specification.

BACKGROUND OF THE INVENTION

1. Field of the Invention

The present invention relates to a connector. More particularly, the present invention relates to a connector suitable for being applied to both a peripheral component interconnection (PCI) card and a peripheral component interconnection express (PCIE) card.

2. Description of Related Art

With the increasing competition of electronic products, executing a strategy of diversifying the products has become a way to achieve market segmentation. It is usual to come to a compromise between product specifications and arrangements of space and traces. For instance, interlaced in-line package pins are often used in a card connector disposed on a circuit board. Owing to a significant pitch among the in-line package pins, only seven card connectors at most can be configured on the circuit board. For example, given that two PCIE X16 connectors are disposed on the circuit board and three PCI connectors are correspondingly disposed on the circuit board, there can only be two PCIE X1 connectors at most correspondingly disposed on the circuit board.

SUMMARY OF THE INVENTION

The present invention is directed to a connector suitable for being applied to both a PCI card and a PCIE card.

In the present invention, a connector having a plurality of surface-mount technology (SMT) pads and a plurality of in-line package pins is provided.

In one embodiment of the present invention, the SMT pads are disposed at the outside of the in-line package pins.

In one embodiment of the present invention, the in-line package pins are dual in-line package pins.

In one embodiment of the present invention, the connector has a body, and the SMT pads are extended and protruded out of a side surface of the body.

In one embodiment of the present invention, the connector has a body, and the SMT pads are flatly adhered to a bottom surface of the body.

In the present invention, a connector suitable for being disposed on a circuit board is provided, and a card is electrically connected to the circuit board through the connector. The connector includes a body, a plurality of SMT pads, and a plurality of in-line package pins. The body has a first surface and a second surface opposite to each other. The first surface has a slot which is suitable for accommodating the card, and the second surface faces toward the circuit board. Each of the SMT pads has a first end and a second end. The first ends are disposed within the body, and the second ends protrude from the second surface of the body for being electrically connected to the circuit board. Each of the in-line package pins has a third end and a fourth end. The third ends are disposed within the body, and the fourth ends protrude from the second surface of the body and are suitable for passing through the circuit board and being electrically connected to the circuit board.

In one embodiment of the present invention, the second ends of the SMT pads are symmetrically distributed onto the second surface.

In one embodiment of the present invention, the second ends of the SMT pads are disposed at the outside of the fourth ends of the in-line package pins.

In one embodiment of the present invention, the in-line package pins are dual in-line package pins.

In one embodiment of the present invention, the fourth ends of the in-line package pins are symmetrically distributed onto the second surface.

In one embodiment of the present invention, the SMT pads are extended and protruded out of a side surface of the body.

In one embodiment of the present invention, the SMT pads are flatly adhered to the second surface of the body.

In one embodiment of the present invention, the first ends of the SMT pads are relatively adjacent to an opening of the slot, while the third ends of the in-line package pins are relatively away from the opening of the slot.

In one embodiment of the present invention, the card includes a PCI card or a PCIE card.

In one embodiment of the present invention, the connector further includes at least a pushing member disposed within the body. When the PCIE card is in contact with the pushing member, the pushing member pushes the first ends.

The SMT pads and the in-line package pins are integrated into one connector according to the present invention. Therefore, the connector of the present invention is suitable for being applied to both the PCI card and the PCIE card. When the connectors of the present invention are applied to the circuit board, the number of the connectors on the circuit board can be reduced, and thereby more space of the circuit board is available for disposing other electrical elements. In addition, the trace layout is more flexible according to the present invention, and manufacturing processes are also simplified.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
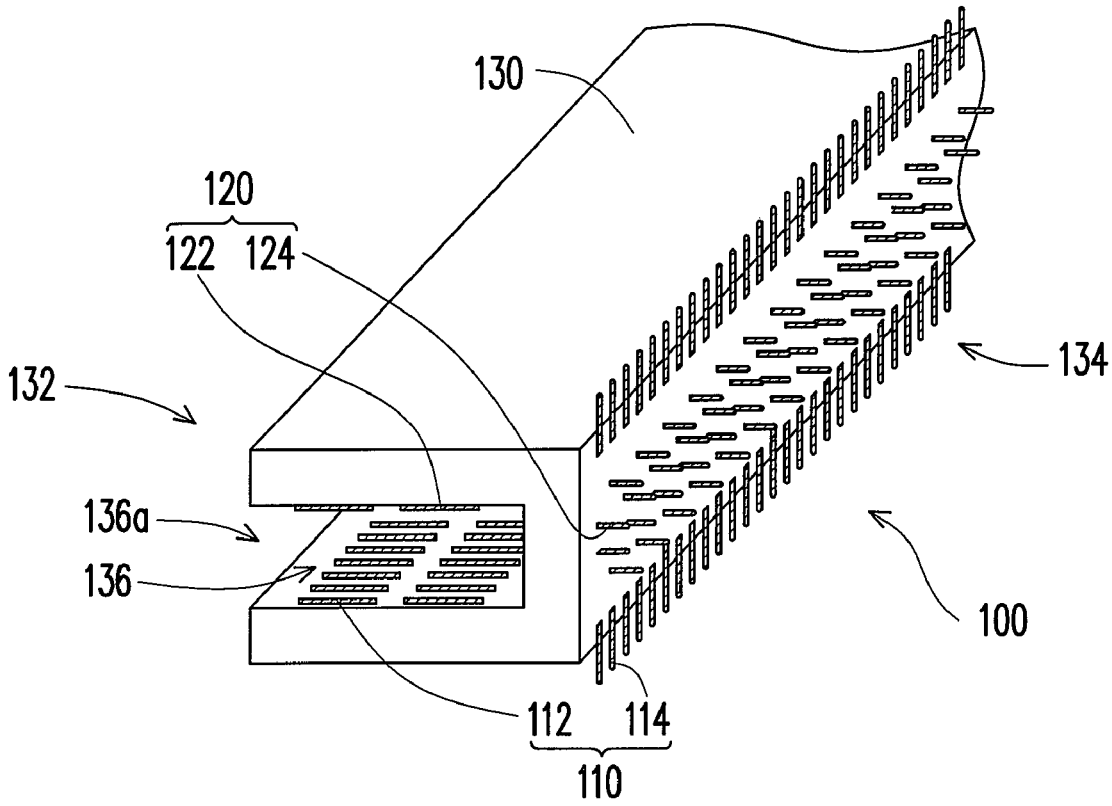
FIG. 1 is a schematic view of a connector according to the present invention.
Figure 2A:
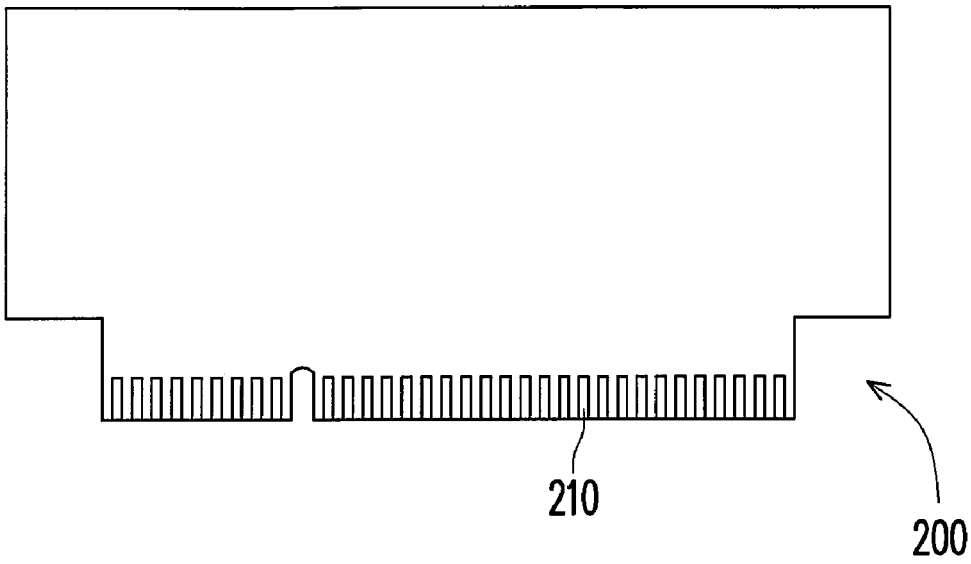
FIGS. 2A and 2B are schematic views of a PCIE card and a PCI card, respectively.
Figure 2B:
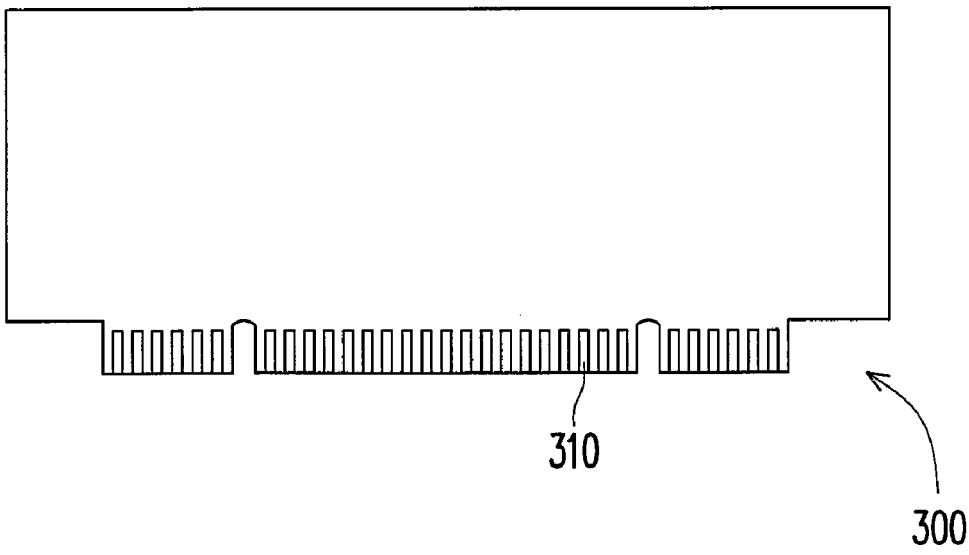

FIG. 1 is a schematic view of a connector according to the present invention. FIGS. 2A and 2B are schematic views of a PCIE card and a PCI card respectively. Referring to FIGS. 1, 2A, and 2B, a connector 100 is suitable for being disposed on a circuit board (not shown), and a card, such as a PCIE card 200 depicted in FIG. 2A or a PCI card 300 depicted in FIG. 2B, can be inserted into the connector 100 to be electrically connected to the circuit board.

The connector 100 has a plurality of SMT pads 110 and a plurality of DIP pins 120. It should be known to people skilled in the pertinent art that single in-line package pins can also be configured in the connector 100 of the present invention. Besides, the non-interlaced SMT pads 110 correspond to the PCI card 300 depicted in FIG. 2B, while the DIP pins 120 correspond to the PCIE card 200 depicted in FIG. 2A. However, in one embodiment of the present invention, the interlaced DIP pins corresponding to the PCI card in the pertinent art can be replaced with the non-interlaced SMT pads 110. As such, a neat arrangement of the pins can be guaranteed, and a pitch among the pins can also be reduced.

It can be deduced from the above that the connector 100 of the present invention is simultaneously equipped with the SMT pads 110 corresponding to the PCI card 300 and the DIP pins 120 corresponding to the PCIE card 200. Hence, the PCI card 300 and the PCIE card 200 can both be inserted into the connector 100. Thereby, the number of the connectors 100 that are disposed on the circuit board can be reduced, and more space of the circuit board is available.

Figure 3:
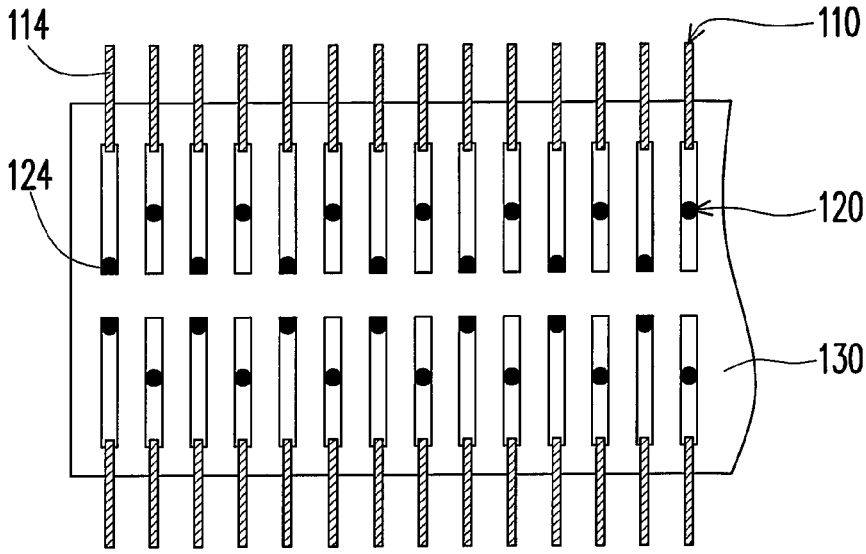
FIG. 3 is a schematic view of a second surface of the connector depicted in FIG. 1.
Figure 4:
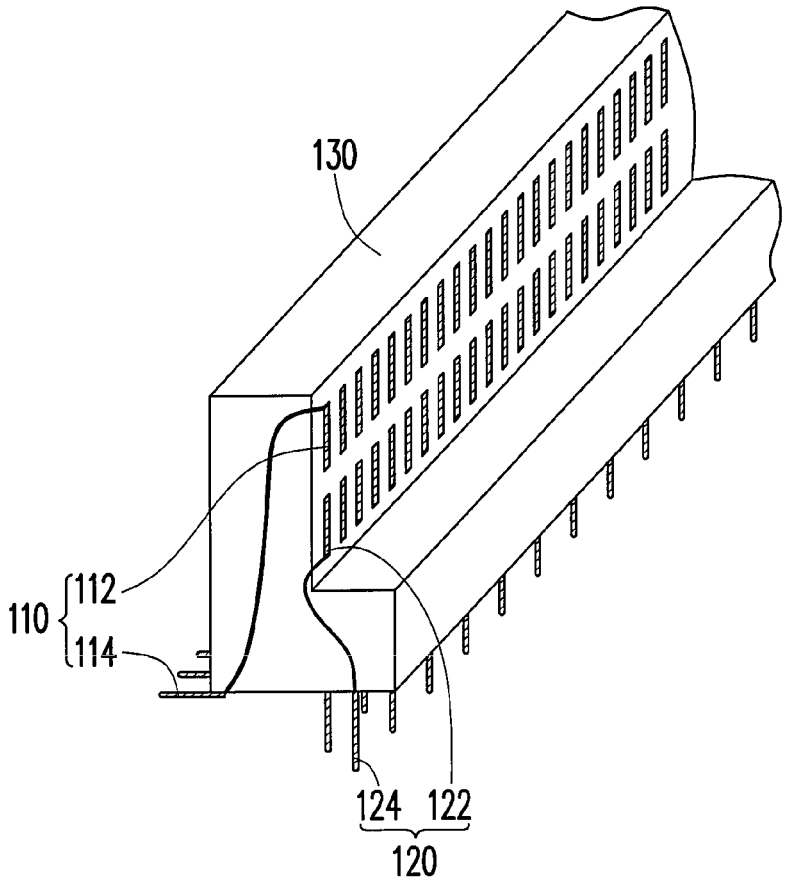
FIG. 4 is a schematic perspective view of the connector depicted in FIG. 1.

FIG. 3 is a schematic view of a second surface of the connector 100 depicted in FIG. 1. FIG. 4 is a schematic perspective view of the connector 100 depicted in FIG. 1. Referring to FIGS. 1, 3, and 4, the SMT pads 110 and the DIP pins 120 of the connector 100 are disposed in a body 130 of the connector 100. The body 130 has a first surface 132 and a second surface 134 opposite to each other. The first surface 132 has a slot 136 which is suitable for accommodating the PCIE card 200 depicted in FIG. 2A and the PCI card 300 depicted in FIG. 2B.

As shown in FIGS. 1 and 4, each of the SMT pads 110 has a first end 112 and a second end 114. The first ends 112 are disposed within the body 130 and exposed by the slot 136, such that the pads 310 of the PCI card 300 is in contact with the first ends 112 when the PCI card 300 is inserted into the connector 100, and thereby the PCI card 300 can be electrically connected to the circuit board through the connector 100. Specifically, the slot 136 has two opposite inner surfaces, and each inner surface has a line of the first ends 112. The second ends 114 protrude from the second surface 134 of the body 130 and are symmetrically distributed onto the second surface 134. Besides, the second ends 114 are bent toward a width direction of the body 130. The second ends 114 protruding from the second surface 134 of the body 130 and bent toward the width direction of the body 130 are bonded to traces disposed on one surface of the circuit board.

Each of the DIP pins 120 has a third end 122 and a fourth end 124. The third ends 122 are disposed within the body 130 and exposed by the slot 136, such that the PCIE card 200 can be electrically connected to the circuit board through the connector 100 when the PCIE card 200 is inserted into the connector 100. And, each inner surface of the slot 136 has a line of the third ends 122 fo med adjacent to the first ends 112 disposed thereon. The fourth ends 124 protrude from the second surface 134 of the body 130. In comparison with the SMT pads 110, the fourth ends 124 of the DIP pins 120 are not bent. Instead, the fourth ends 124 pass through the circuit board and are bonded to traces disposed on the other surface of the circuit board.

Based on the above, the second ends 114 of the SMT pads 110 and the fourth ends 124 of the DIP pins 120 are positioned on the second surface 134 of the body 130. Additionally, in one embodiment of the present invention, the second ends 114 of the SMT pads 110 can be disposed at the outside of the fourth ends 124 of the DIP pins 120. As such, the second ends 114 of the SMT pads 110 would not be electrically connected to the fourth ends 124 of the DIP pins 120, and it is easier when the connector 100 is assembled to the circuit board. Moreover, the fourth ends 124 of the DIP pins 120 can be randomly disposed at the inside of the second ends 114 of the SMT pads 110 or symmetrically distributed at the inside of the second ends 114 of the SMT pads 110, which is determined upon demands for actual use or design.

Conventionally, the height of the slot for the PCI card is different from the height of the slot for the PCIE card. Therefore, the depths of the PCI card 300 depicted in FIG. 2B and the PCIE card 200 depicted in FIG. 2A inserted in a slot of a conventional connector correspondingly are different. In view of the foregoing, the first ends 112 of the SMT pads can be disposed relatively adjacent to an opening 136*a* of the slot 136, while the third ends 122 of the DIP pins 120 can be disposed relatively away from the opening 136*a* of the slot 136. As such, when the PCI card 300 depicted in FIG. 2B is inserted into the slot 136 of the connector 100, the PCI card 300 merely contacts the first ends 112 of the SMT pads 110.

Figure 5:
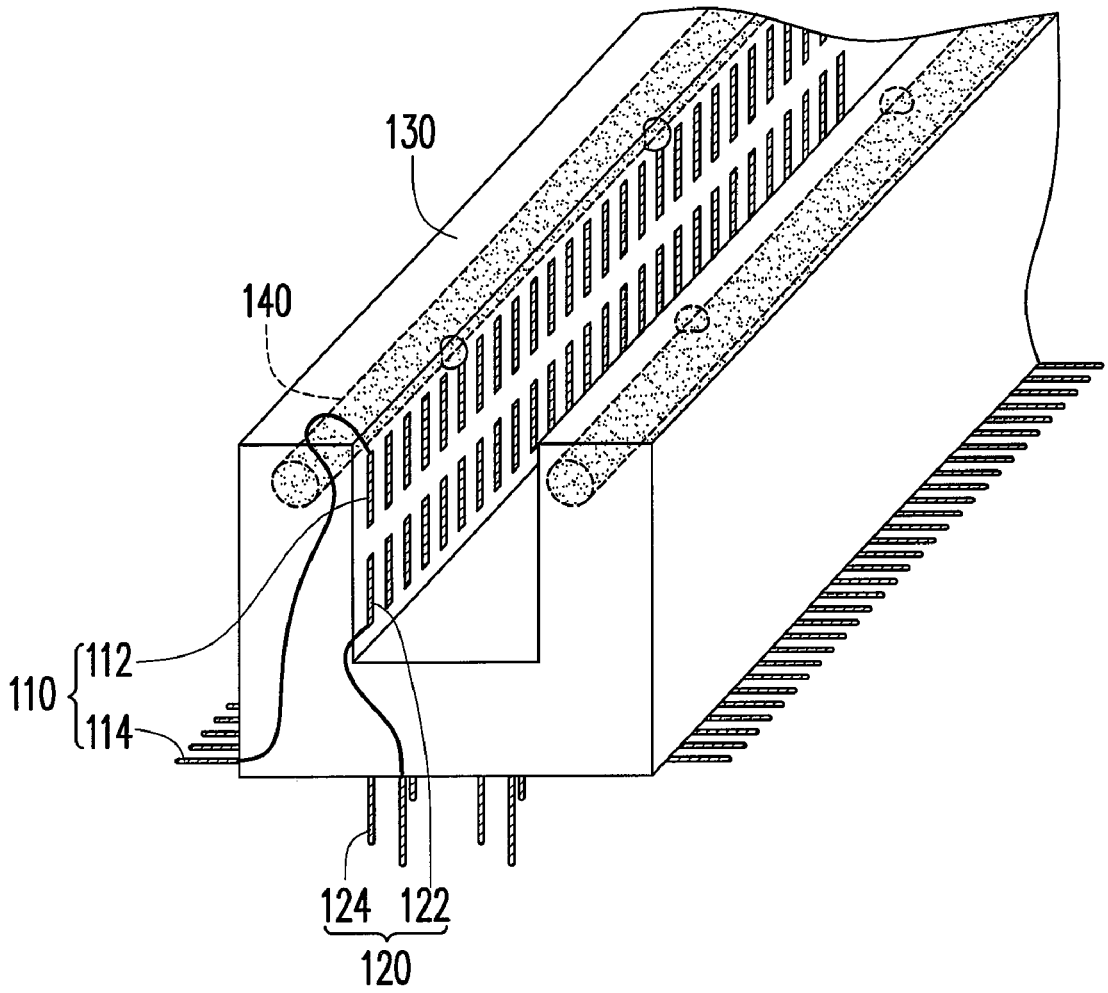
FIG. 5 is a schematic view showing a pushing member disposed in the connector.

However, when the PCIE card 200 depicted in FIG. 2A is inserted into the slot 136 of the connector 100, the PCIE card 200 not only contacts the third ends 122 of the DIP pins 120 but also possibly contacts and electrically connects the first ends 112 of the SMT pads 110 because the PCIE card 200 is inserted into the slot 136 of the connector 100 to a relatively great depth. As such, signal transmission between the PCIE card 200 and the circuit board is affected. FIG. 5 is a schematic view of a pushing member disposed in the connector. In order to prevent the pads 210 of the PCIE card 200 from being electrically connected to the first ends 112 of the SMT pads 110, the connector 100 further includes at least a pushing member 140 that is disposed within the body 130 and is suitable for pushing away the first ends 112 of the SMT pads 110 when the PCIE card 200 is inserted into the slot 136. Note that the shape of the PCI card 300 is different from the shape of the PCIE card 200. Hence, when the PCI card 300 is inserted into the connector 100, the pushing member 140 would not be pushed away by the PCI card 300. Nevertheless, as the PCIE card 200 is inserted into the connector 100, the PCIE card 200 pushes away the pushing member 140 toward a direction of a side surface of the connector 100, and the pushing member 140 then pushes away the first ends 112 of the SMT pads 110.

Figure 6:
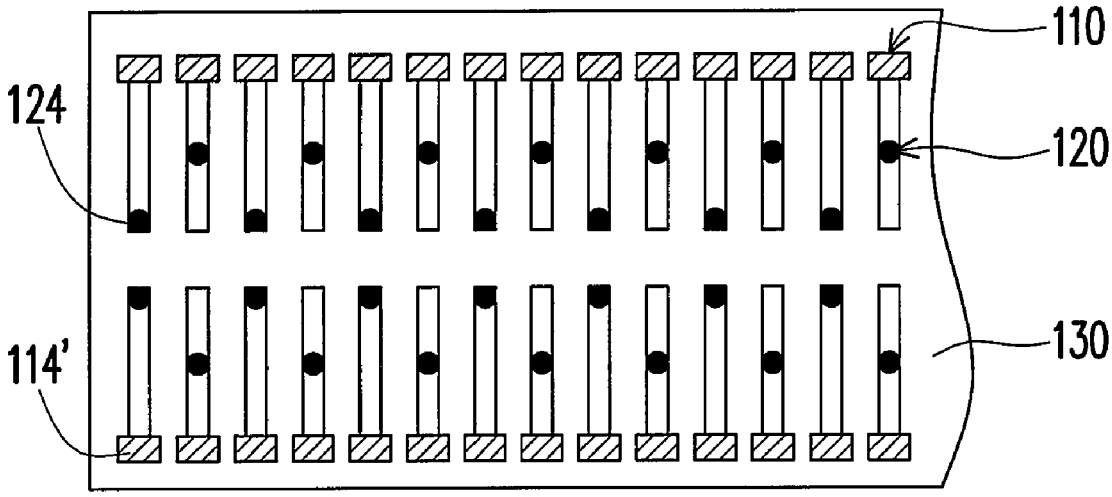
FIG. 6 is a schematic view showing that SMT pads of the connector are disposed on the second surface according to another embodiment of the present invention.

Notwithstanding the second ends 114 of the SMT pads 110 are extended and protrude from the side surface of the body 130 of the connector 100, it is likely for people skilled in the pertinent art to, based on their experiences related to this technical field and other accessible publications and citations, modify the shape of the second ends 114 of the SMT pads 110 and adjust relevant positions of the second ends 114 configured in the body 130. FIG. 6 is a schematic view showing that SMT pads 110 of the connector 100 are disposed on the second surface 134 according to another embodiment of the present invention. As shown in FIG. 6, the connector 100 can be bonded to the circuit board (not shown) with use of solder paste. Hence, second ends 114' of the SMT pads 110 can be flatly adhered to a pad on a surface of the body 130. In an alternative, the second ends 114' of the SMT pads 110 can also be retracted inward into the side surface of the body 130 instead of being extended and protruding from the side surface of the body 130.

Based on the foregoing, the connector of the present invention can be applied to both the PCI card and the PCIE card, and thereby the number of the connectors disposed on the circuit board can be reduced. As a result, not only more space of the circuit board is available for other electrical elements to be disposed, but also the trace layout is less complicated but more flexible. Furthermore, since the complexity of the trace layout is reduced, a signal transmission quality can be assured to a better extent. On the other hand, even though the pitch among the pins can be reduced when the conventional interlaced DIP pins are replaced with the non-interlaced SMT pads, said pitch still has a predetermined value. Therefore, the connector of the present invention remains prone to be manufactured and assembled, and manufacturing yield can also be maintained.

In view of the above, the connector of the present invention at least has the following advantages:

1. The number of the connectors disposed on the circuit board can be reduced, and thereby more space of the circuit board is available for other electrical elements to be disposed.
2. The trace layout can be more flexible after the number of the connectors disposed on the circuit board is reduced, and the complexity of the trace layout can be decreased as well.
3. Since the complexity of the trace layout is reduced, the signal transmission quality can be better assured.
4. Both the SMT pads and the in-line package pins are configured in the connector of the present invention, and therefore the dimension of the connector can be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector, comprising:

a U-shaped body with a first surface having a slot, a plurality of surface-mount technology (SMT) pads protruded from a second surface opposite to the first surface of the body;

a plurality of surface-mount technology (SMT) pads and a plurality of in-line package pins are imbedded in the body and are arranged into a plurality of rows;

a front portion of the plurality of the surface-mount technology (SMT) pads are aligned in rows with the front portions of the in-line package pins in the slot;

a rear portion of the plurality of the surface-mount technology (SMT) pads are bent outward in a direction parallel to the first surface of the body;

a rear portion of the plurality of the in-line package pins are offset in every other rows.

2. The connector as claimed in claim 1, wherein the SMT pads are disposed at the outside of the in-line package pins.

3. The connector as claimed in claim 1, wherein the in-line package pins are dual in-line package pins.

4. The connector as claimed in claim 1, wherein the SMT pads are extended and protruded out of the second surface of the body.

5. The connector as claimed in claim 1, wherein the SMT pads are flatly adhered to the second surface of the body.

6. The connector as claimed in claim 1, wherein the ends of the SMT pads are relatively adjacent to an opening of the slot, while the ends of the in-line package pins are relatively away from the opening of the slot.

7. A connector suitable for being disposed on a circuit board, a card being electrically connected to the circuit board through the connector, the connector comprising:

a U-shaped body, having a first surface and a second surface opposite to each other, wherein the first surface has a slot suitable for accommodating the card, and the second surface faces toward the circuit board;

a plurality of SMT pads, each SMT pad having a first end and a second end, wherein the first ends are embedded within the body, and the second ends protrude from the second surface of the body and are bent toward a width direction of the body suitable for being electrically connected to the circuit board; and a plurality of in-line package pins, each in-line package pin having a third end and a fourth end, wherein the third ends are embedded within the body, and the fourth ends protrude from the second surface of the body and are suitable for passing through the circuit board and being electrically connected to the circuit board;

the first ends of the plurality of the surface-mount technology (SMT) pads are aligned in rows with the third ends of the in-line package pins in the slot;

the fourth ends of the plurality of the in-line package pins are offset in every other rows.

8. The connector as claimed in claim 7, wherein the second ends of the SMT pads are symmetrically distributed onto the second surface of the body.

9. The connector as claimed in claim 7, wherein the second ends of the SMT pads are disposed at the outside of the fourth ends of the in-line package pins.

10. The connector as claimed in claim 7, wherein the SMT pads are extended and protruded out of a side surface of the body.

11. The connector as claimed in claim 7, wherein the SMT pads are flatly adhered to the second surface of the body.

12. The connector as claimed in claim 7, wherein the first ends of the SMT pads are relatively adjacent to an opening of the slot, while the third ends of the in-line package pins are relatively away from the opening of the slot.

13. The connector as claimed in claim 7, further comprising at least a pushing member disposed within the body when the card is a peripheral component interconnection express (PCIE) card, the at least a pushing member pushing the first ends when the PCIE card contacts the pushing member.

14. The connector as claimed in claim 7, wherein the in-line package pins are dual in-line package pins.

15. The connector as claimed in claim 14, wherein the fourth ends of the in-line package pins are symmetrically distributed onto the second surface of the body.

* * * * *